United States Patent [19]

Appelgren

[11] 4,257,195

[45] Mar. 24, 1981

[54] DEBURRING AND CHAMFERING FIXTURE

[76] Inventor: Donald W. Appelgren, 8647 Wayside, Apt. 9, Brighton, Mich. 48116

[21] Appl. No.: 67,754

[22] Filed: Aug. 20, 1979

[51] Int. Cl.[3] ..... B24B 41/06

[52] U.S. Cl. ..... 51/124 R; 51/143; 51/216 R; 51/238 R

[58] Field of Search ..... 51/96, 124 R, 135 R, 51/143, 216 R, 216 A, 218 A, 218 R, 234, 238 R, 238 S, 240 R, 240 A

[56] References Cited

U.S. PATENT DOCUMENTS

| | | | |
|---|---|---|---|
| 411,845 | 10/1889 | Walker | 51/124 R |
| 798,538 | 8/1905 | Stedman | 51/124 R |
| 955,934 | 4/1910 | Ashton | 51/124 R |
| 1,482,296 | 1/1924 | Gouldbourn et al. | 51/218 R |
| 3,512,309 | 5/1970 | Grieco | 51/218 R |
| 4,176,499 | 12/1979 | Mazoff | 51/124 R |

FOREIGN PATENT DOCUMENTS

| | | | |
|---|---|---|---|
| 2512526 | 9/1976 | Fed. Rep. of Germany | 51/135 R |

*Primary Examiner*—Gary L. Smith
*Assistant Examiner*—Robert P. Olszewski
*Attorney, Agent, or Firm*—Barnes, Kisselle, Raisch & Choate

[57] ABSTRACT

A fixture for deburring or chamfering corner edges of a workpiece. The fixture has a base adapted to be mounted on the table of a sanding or grinding machine of the type having a motor driven belt or disc which travels in a plane perpendicular to the machine table. The workpiece support table is rockably mounted on the machine table and has a pair of perpendicularly related upright guide plates the converging ends of which are spaced slightly apart to form a slot for accomodating the corner portion of the workpiece to be deburred or chamfered.

4 Claims, 4 Drawing Figures

DEBURRING AND CHAMFERING FIXTURE

This invention relates to a deburring or chamfering fixture.

In many metal fabricating operations rectangularly shaped workpieces are initially sawed or cut in a manner such that a burr is formed along oen or more straight edges of the workpieces. Frequently such burrs must be removed before further processing or at least from the finished workpiece. Other rectangular workpieces as initially fabricated have sharp corner edges which are desirably bevelled at least slightly by a chamfering operation before further processing. The operation of deburring or chamfering such workpieces can be relatively expensive especially if it is desired to control the final size of the workpiece or the size of the chamfer.

The present invention has for its object the provision of a relatively simple fixture that is readily attachable to a sanding or grinding machine and which enables a workpiece to be deburred or chamfered uniformly and accurately in a simple and safe manner.

Other objects, features and advantages of the present invention will become apparent from the following description and accompanying drawings, in which.

Figure 1:
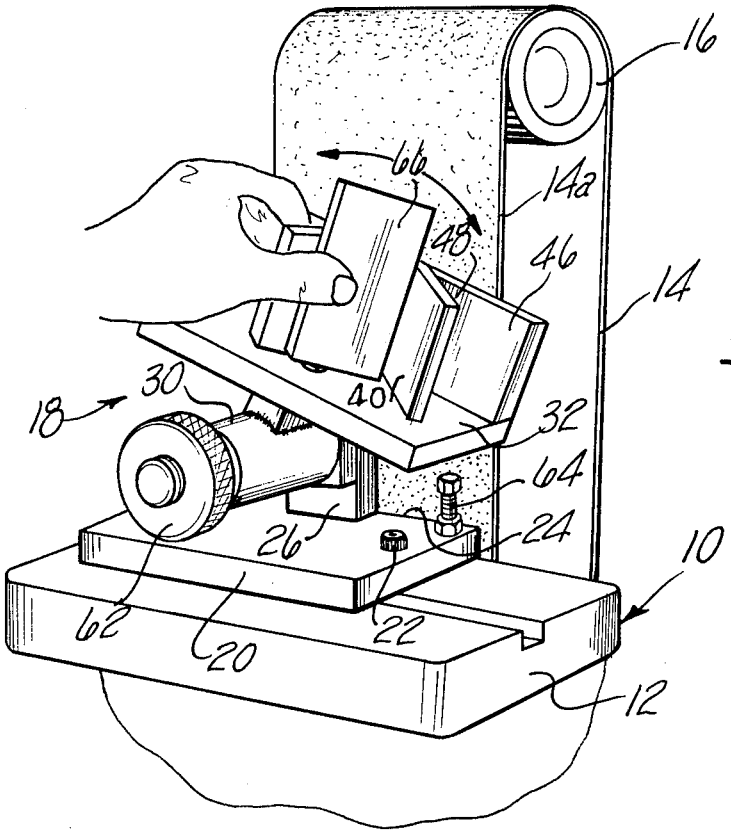
FIG. 1 is a fragmentary perspective view of a sanding machine having the fixture of the present invention mounted thereon.

Referring to FIG. 1 there is illustrated a conventional sanding machine 10 having a table 12 and an endless sanding belt 14 trained around a pair of vertically spaced rollers one of which is illustrated at 16. Belt 14 is driven by one of the rollers so that the run 14a is in a vertical plane perpendicular to the top face of table 12. The fixture of the present invention generally designated at 18 is mounted on the top face of table 12.

Figure 2:
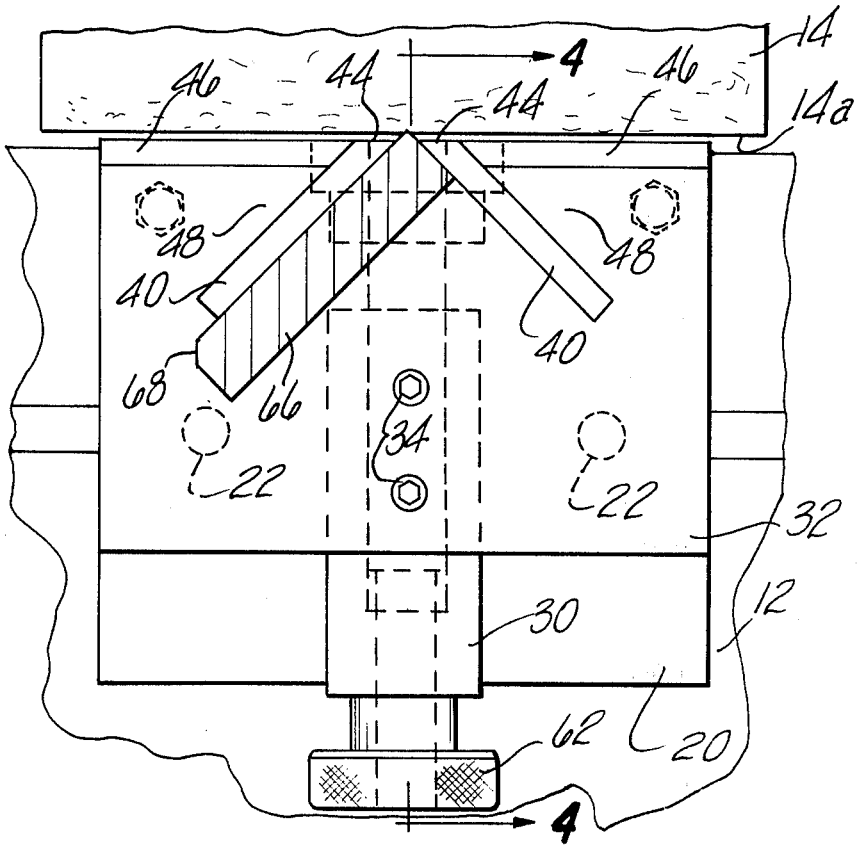
FIG. 2 is a top plan view of the fixture.
Figure 3:
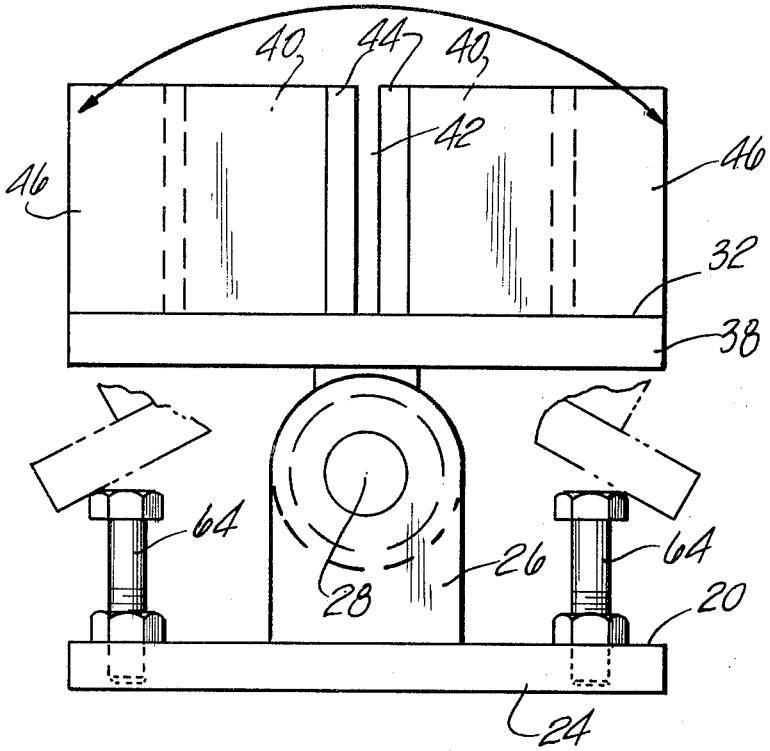
FIG. 3 is an end view of the fixture.
Figure 4:
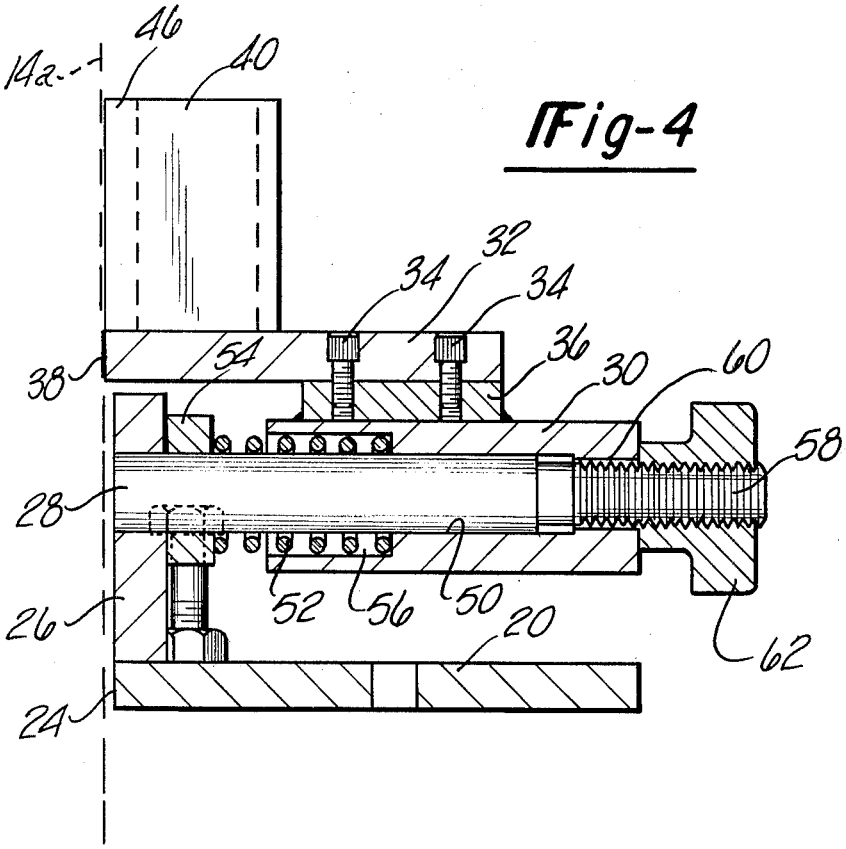
FIG. 4 is a sectional view along the line 4—4 in FIG. 2.

The fixture 18 comprises a base plate 20 secured to table 12 by screws 22 so that its straight front edge 24 is spaced closely adjacent and generally parallel to the run 14a of belt 14 as illustrated in FIGS. 2 and 4. An upright bracket 26 mounted on the top side of base plate 20 adjacent its front edge 24 has a shaft 28 press fitted or otherwise secured therein so that its axis is spaced above and extends parallel to the top face of base plate 20. A tubular bushing 30 is journalled on shaft 28. Bushing 30 is secured to a work support table 32 by means of screws 34 and a spacer pad 36. Table 32 is generally rectangularly shaped and has a front edge 38 which extends along a line parallel to the plane of the run 14*a* of belt 14. On the top face of table 32 there is fixedly mounted a pair of upright guide plates 40. Guide plates 40 are perpendicular to the plane table 32 and are arranged so that they are perpendicular to one another; that is, the included angle therebetween is 90°. These guide plates converge toward the front edge 38 of table 32 and at the front edge 38 they are spaced apart slightly so as to form a vertical slot 42 therebetween. The forward edge faces 44 of guide plates 40 are bevelled at an angle of 45° to the plane of the guide plates and are aligned vertically with the forward edge 38 of table 32. There is also mounted on the top side of table 32 a pair of upright guard plates 46 the front faces of which are coplanar with the end faces 44 of guide plates 40. Each guard plate 46 cooperates with its adjacent guide plate 40 to form a finger pocket 48 therebetween.

Tubular bushing 30 has a central bore 50 which has a close sliding fit with shaft 28 so that table 32 is supported on shaft 28 for rocking movement as well as axial sliding movement. A compression spring 52 is arranged between a pad 54 on shaft 28 and the inner end of a counter-bore 56 is bushing 30. The rear end of shaft 28 is threaded as at 58 and projects outwardly through an opening 60 at the rear end of bushing 30. An adjustment knob 62 is threaded on the projecting end of shaft 28. Compression spring 52 biases bushing 30 rearwardly so that it is at all times pressed against knob 62. The extent of rocking movement of table 32 in opposite directions is controlled by a pair of vertically adjustable screws 64 which are threaded into base plate 20.

In operation knob 62 is adjusted on shaft 28 such that the front edge 38 of table 32 is spaced rearwardly from the run 14*a* of belt 14 a selected pre-determined distance. Thereafter a rectangular workpiece 66 is placed on table 32 with the corner edge thereof to be chamfered or deburred extending vertically and adjacent the slot 42. The workpiece is held flat against one of the guide plates 40 in the manner illustrated in FIG. 1 and the workpiece is advanced on table 32 so that the corner to be chamfered or deburred is advanced into the plane of the sanding belt run 14*a*. When the forward end of the workpiece engages the other guide plate 40, a chamfer or bevelled edge of pre-determined size is formed at the corner of the workpiece as shown in FIG. 2. It is apparent that all perpendicularly related edges of the workpiece can be deburred or bevelled in this fashion. One such bevelled edge is illustrated at 68 in FIG. 2. The bevelling action is obtained by simply rocking of the table 32 on shaft 28 to the extent permitted by screws 64 while advancing the workpiece into the sanding belt. Screws 64 are adjusted so that the edge of the workpiece being bevelled always lies within the width of the sanding belt 14. The size of the bevel formed on the workpiece is determined by adjusting knob 62 so as to shift table 32 toward and away from the plane of the belt run 14*a*.

It will be appreciated that the workpiece may be held on table 32 with one hand as shown in FIG. 1 or with both hands. In either event the pockets 48 formed by the guide plates 40 will protect the operator's fingers from contact with the sanding belt 14. It will also be appreciated that in place of a sanding machine such as shown at 10 the fixture 18 can also be used on a grinding machine wherein the abrasive element is in the form of a grinding disc or wheel which likewise rotates in a plane perpendicular to table 10.

I claim:

1. A fixture for deburring or chamfering perpendicularly related edges of workpieces which comprises a base adapted to be fixedly mounted on the table of a sanding or grinding machine of the type having a flat abrasive element such as a belt or disc powered to travel in a plane perpendicular to the plane of the machine table, a work support table pivotally mounted on said base for rocking movement about an axis parallel to the plane of said base, said base being adapted to be mounted on said machine table so that one edge of the table is adjacent said abrasive element and said axis is perpendicular of the flat face of the abrasive element, a pair of upright guide plates fixedly mounted on said support table symmetrically on opposite sides of said axis, each of said guide plates being inclined to said axis at an angle of 45° so that the guide plates are perpendicularly related and converge toward the axis adjacent said one edge of the work support table, the inner opposed faces of said guide plates terminating adjacent said edge of the support table in slightly laterally spaced relation so that a workpiece having two perpendicularly related intersecting faces is adapted to be engaged with the guide plates such that the corner edge portion thereof defined by the intersection of said two perpendicularly related faces projects through the slot defined by the laterally spaced converging ends of the guide plates, a pair of upright guard plates on said support table, each of said guard plates being mounted on said work support table adjacent said one edge thereof and extending laterally outwardly in opposite directions from the converging ends of the guide plates to form a protective finger pocket adjacent each guide plate, and means for adjusting said table axially along said pivotal axis to control the extent to which said corner portion of the workpiece can be advanced into the plane of the flat face of the abrasive element.

2. A fixture as called for in claim 1 wherein each guard plate is disposed at an angle at substantially 45° to the plane of the adjacent guide plate.

3. A fixture as called for in claim 2 wherein the end faces of the guide plates at the converging ends thereof are coplanar and perpendicular to said axis.

4. A fixture as called for in claim 3 wherein the outer faces of the guard plates are substantially coplanar with said end faces of the guide plates.

* * * * *